US005255536A

United States Patent [19]

Jung et al.

[11] Patent Number: 5,255,536

[45] Date of Patent: Oct. 26, 1993

[54] DEFROST ASSEMBLY

[75] Inventors: Gyoo H. Jung, Suweon; Man H. Kim, Seoul; Kyung I. Lee, Suweon, all of Rep. of Korea

[73] Assignee: Samsung Electronics Co., Ltd., Suwon, Rep. of Korea

[21] Appl. No.: 814,704

[22] Filed: Dec. 30, 1991

[30] Foreign Application Priority Data

| | | | |
|---|---|---|---|
| Dec. 31, 1990 | [KR] | Rep. of Korea | 90-22045[U] |
| Jul. 4, 1991 | [KR] | Rep. of Korea | 91-10218[U] |
| Jul. 15, 1991 | [KR] | Rep. of Korea | 91-10930[U] |
| Jul. 16, 1991 | [KR] | Rep. of Korea | 91-11088[U] |

[51] Int. Cl.[5] ..... F25D 21/06

[52] U.S. Cl. ..... 62/515; 62/275; 62/276

[58] Field of Search ..... 62/80, 515, 150, 151, 62/154, 156, 272, 275, 276; 165/64; 219/201

[56] References Cited

U.S. PATENT DOCUMENTS

| | | | |
|---|---|---|---|
| 2,863,303 | 12/1958 | Wurtz . | |
| 2,909,910 | 10/1959 | Saunders | 62/275 |
| 2,912,834 | 11/1959 | Mann | 62/276 |
| 2,940,277 | 6/1960 | Pas et al. | 62/276 X |
| 3,059,446 | 10/1962 | Constantini et al. | 62/150 |
| 3,107,501 | 10/1963 | Stickel | 62/276 X |
| 3,138,006 | 6/1964 | Moorman et al. | 62/276 X |
| 3,164,970 | 1/1965 | Hubacker | 62/276 X |
| 3,224,216 | 12/1965 | Crouch | 62/275 X |
| 3,393,530 | 7/1968 | Koch | 62/276 X |
| 3,899,895 | 8/1975 | Blanton et al. | 62/80 X |

FOREIGN PATENT DOCUMENTS

| | | | |
|---|---|---|---|
| 0136673 | 5/1990 | Japan | 62/151 |
| 1421957 | 9/1988 | U.S.S.R. | 62/276 |

*Primary Examiner*—Henry A. Bennet
*Assistant Examiner*—Christopher B. Kilner
*Attorney, Agent, or Firm*—Burns, Doane, Swecker & Mathis

[57] ABSTRACT

A defrost assembly for the evaporator of a refrigerator comprises a thin heating plate of thermally conductive material underlying the evaporator. An electric cord is mounted to an underside of the heating plate for heating the heating plate. A thermal insulating board underlies the heating plate. A thermally responsive cut-off terminates flow to the electric cord when the evaporator reaches a prescribed temperature. A rear portion of the heating plate forms a channel for draining-off melted water.

9 Claims, 5 Drawing Sheets

FIG. 5
(PRIOR ART)
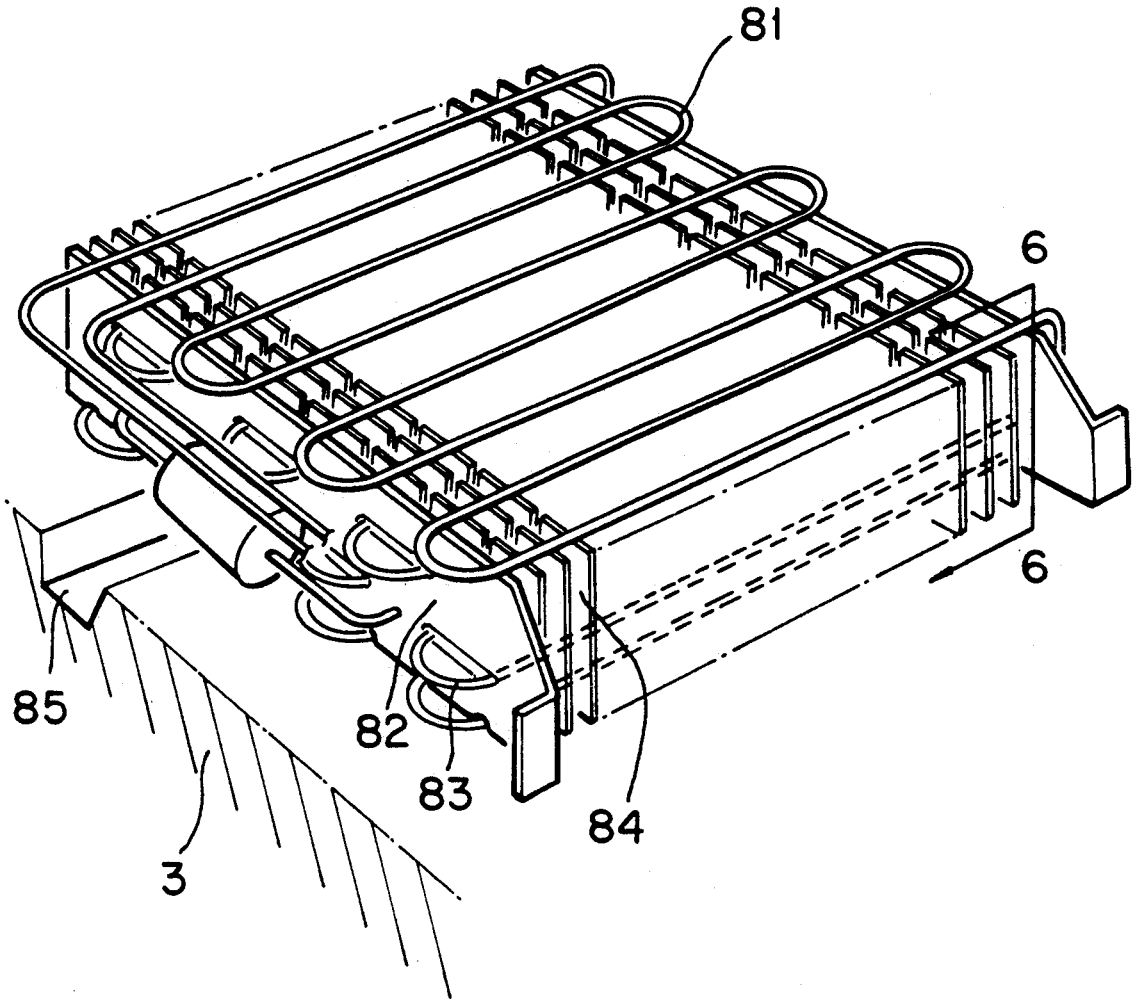
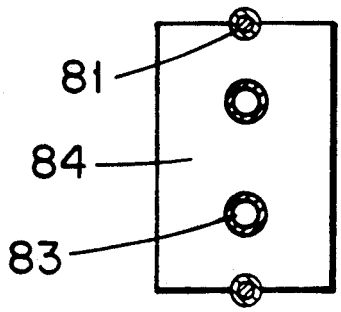
FIG. 6
(PRIOR ART)

DEFROST ASSEMBLY

BACKGROUND OF THE INVENTION

The invention is related to improving the defrost assembly of an evaporator which is provided in a cooling air channel that is formed at the intermediate wall between the freezing compartment and the refrigerating compartment, and more particularly to improving a defrost assembly which increases the efficiency of the cooling air through the channel, which achieves an even and complete defrost over the evaporator, and prevents excessive heating of the cord heater and heat deformity of the components of the refrigerator.

Referring to FIG. 4, a body 1 of a conventional refrigerator comprises a freezing compartment 5 and a refrigerating compartment 6 which are divided by a top partition 2 and a bottom partition 3. Between the top partition 2 and the bottom partition 3 an evaporating channel 7 is provided, in which an evaporator 8 is placed for heat-exchanging the air fed through from the refrigerated spaces 5,6. Cooling air generated from the evaporator 8 is fed into an exiting passage 10 and is diverted into the freezing compartment 5 and the refrigerating compartment 6 by a fan 9. With this system, a food product to be frozen is stored in the freezing compartment 5 while a food product to be kept in a higher temperature is stocked in the refrigerating compartment 6. By this means, in the structural refrigerator the relatively cool refrigerant passing through the evaporator 8 absorbs heat from the relatively hot moist air coming from the refrigerated spaces 5,6. The difference in temperature between the refrigerant and the air causes ice to be formed on the evaporator 8. To melt the ice, the conventional defrost assembly uses heat tubes 81,81 embedded respectively on the top and bottom portion of a plurality of fins 84 as seen in FIGS. 5 and 6, to which the power is periodically supplied in order to allow the iced evaporator 8 to melt. That is, the evaporator 8 comprises a bracket 82 mounted in the direction of the cooling air, a refrigerant tube 83 which is connected with brackets 82,82 in a plurality of loops, a plurality of fins 84 juxtaposed between the brackets 82,82 which are secured to the tube 83 for widening the heat-exchanging surface, and the heat tube 81 embedded respectively throughout the top and bottom portions of the fin 84 and that of the bracket 82 for melting away the ice on the evaporator 8. On the bottom surface of the evaporating channel 7 the heater cord 31 is provided to prevent the defrost water, which is dropped from the evaporator 8 as the heat tube 83 works, from refreezing. However, because the conventional defrost assembly utilizes the heat tube 81 placed on both sides of the evaporator 8, the volume of the evaporator 8 increases. In order to make the complicated element, many manufacturing process are required. With the line contact between the heat tube 81 to the bracket 82 and the fin 84, an even defrosting of the evaporator 8 is difficult to achieve. Even if the respective gaps in the juxtaposition of the fins 84 are to be relatively narrow in order to receive a more even frost free state from the ice on the evaporator, icing on the fins interrupts the cold air flow through the evaporator, resulting in the inefficiency of the refrigerator. Further, on the downward side of the rear portion of the evaporator the drain channel 85 is provided for the drain water of the evaporator. Due to the drain channel 85 the cold air fed into the front portion of the evaporator does not flow via the terminated portion of the evaporator, thereby resulting in the lower efficiency of the refrigeration. However, the problem described below occurs to the defrost assembly which solves the problem described above. As the temperature of the heating plate, located under the bottom surface of the evaporator, increases, the excessive heat of the heating plate is conducted to the foam insulating material of the intermediate partition and deforms the insulating material which has a relative low heat-resistance. Furthermore, if more insulating material is used to improve the heat-resistance, a problem occurs in that the available volume in the food storage space of the refrigerator is reduced. Additionally, if the heating plate is positioned under the bottom surface of the evaporator and the bimetal and the temperature fuse are positioned between the refrigerant tubes of the evaporator, another problem described below arises. The bimetal serves as the means to prevent the heat plate from receiving excessive heat by cutting the electricity to the heat plate by detecting the temperature of the evaporator. However, when the temperature fuse accompanying the bimetal starts the operation due to the fact that the bimetal is out-of-order, the temperature of the heat plate reaches a higher temperature. This increase in temperature creates a problem because the insulating material under the heat plate becomes deformed and the likelihood of a fire increases. Even when the excessive heat of the heat plate can be prevented when the operating temperature of the fuse is reduced, another problem is that the fuse sometimes erroneously cuts off occasionally where the surrounding temperature is high, as in summer.

SUMMARY OF THE INVENTION

In view of the foregoing problems, an object of the present invention is to provide a defrost assembly which separates a heat tube from the evaporator in order to minimize the volume of the evaporator, thereby increasing the efficiency of the refrigerator by providing a sufficient passage space for cooling air.

Another object of the present invention is to provide a defrost assembly which has a heating plate consisting of a cord heater at the bottom surface of the evaporator, thereby achieving the even distribution of the defrosting effect over the evaporator.

Another object of the present invention is to provide a defrost assembly which has an insulating plate placed between the foam resin insulating material and the bottom surface of the evaporator, thereby preventing the foam resin insulating material from igniting.

Another object of the present invention is to provide a defrost assembly which has the temperature fuse superimposed on the heating plate to avoid the change of deformity of the parts of the refrigerator, caused by the excessive heat of the heating plate when the bimetal is out of order, thereby achieving greater reliability over the refrigerator.

According to the present invention, the defrost assembly comprises a heating plate placed below the bottom surface of the evaportor and extending through the bottom surface of the evaporator, an insulating plate having a thermostable and fire-extinguishing characteristics and interposed between the heating plate and the intermediate partition of the refrigerator, a temperature fuse separated from a bimetal attached to the refrigerant tube at the entrance of the evaporator and superimposed on the heating plate at the entrance of the evaporator.

Because the feature of the heat plate in the defrost assembly is formed with the structure which causes the minimum height of the evaporator, the volume of cooling air flowing into the evaporating chamber is increased.

Since the feature of the heat plate in the defrost assembly is formed with the contacting structure to the evaporator causing an even defrosting effect against the evaporator, the resistance to the flow of cooling air, which results from a lump of ice forming on the evaporator, is minimized.

Further, since the front line of the drain borders on the rear end of the evaporator, the flow of the cooling air is prevented from being diverted to the drain, thereby increasing the overall efficiency of the evaporator.

Further, since a part of the space previously occupied by the foam insulating material is replaced with the insulating board, the usable space in the refrigerator can be increased.

Furthermore, since the temperature fuse is positioned at the critical point where it is able to accurately detect the temperature of the heat plate, it prevents the elements of the refrigerator from being deformed by the excessive heat of the heat plate.

BRIEF DESCRIPTION OF DRAWINGS

FIG. 5 is a perspective view of an evaporator having the defrost assembly according to the prior art; and FIG. 6 is a cross section taken on line 6—6 in FIG. 5.

DESCRIPTION OF THE PREFERRED EMBODIMENT

Figure 1:
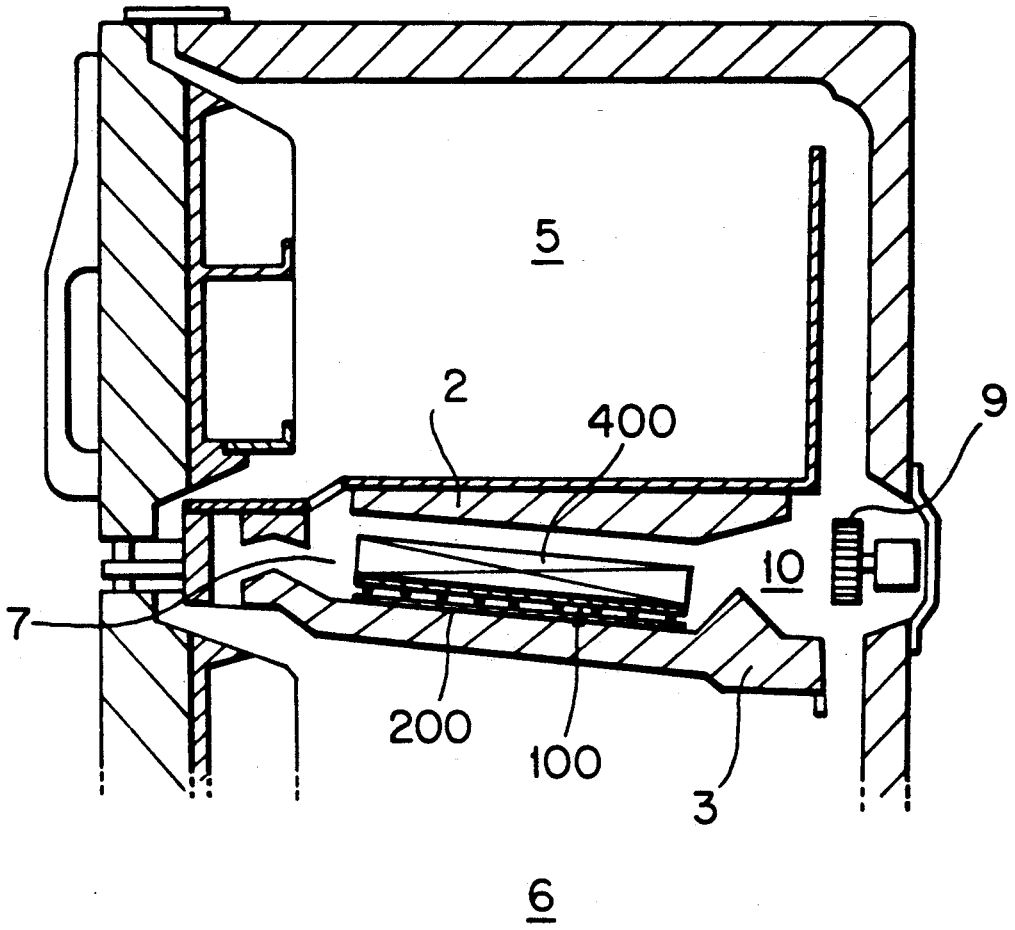
FIG. 1 is a sectional view illustrating a refrigerator having a defrost assembly according to the present invention.
Figure 2:
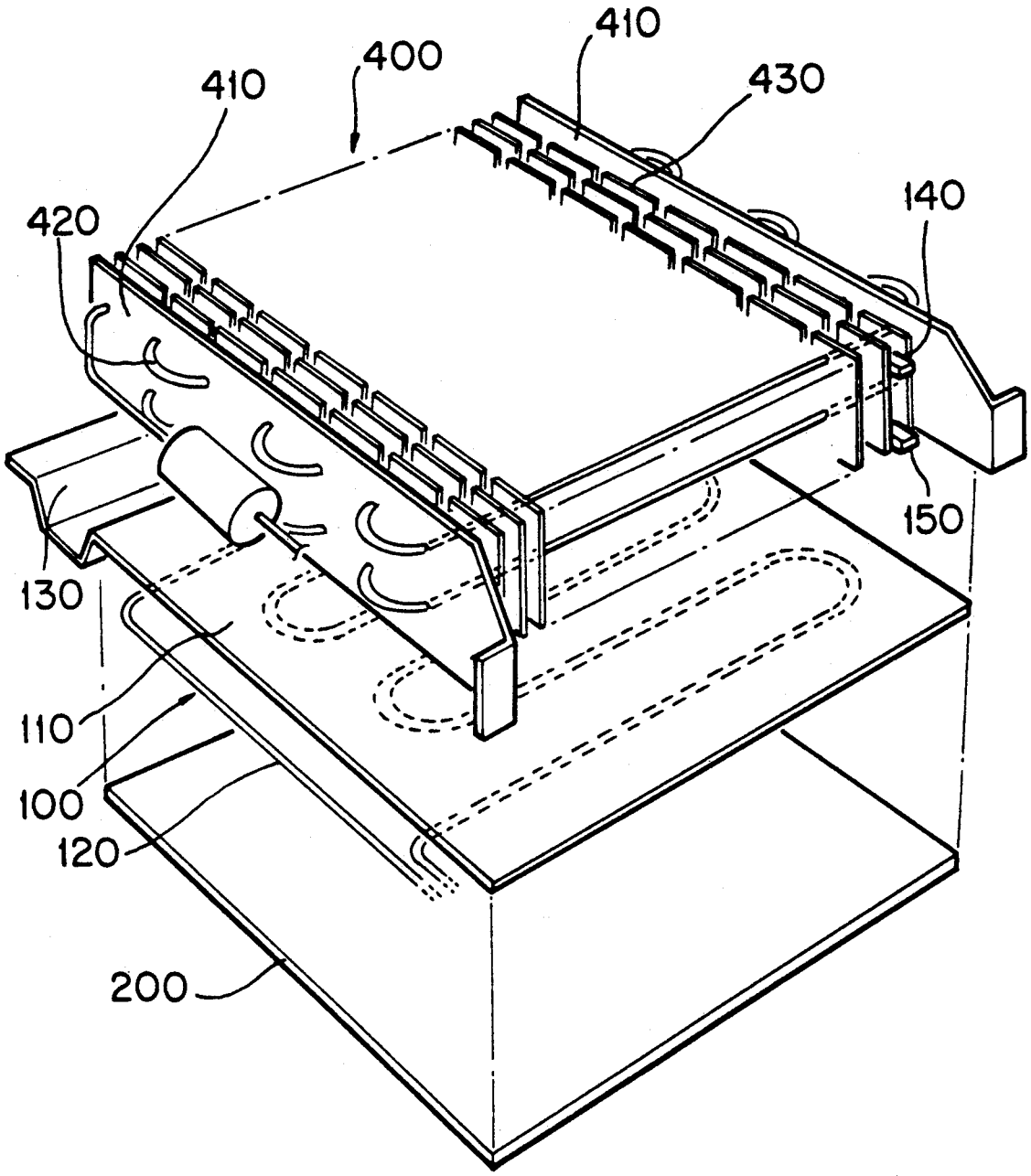
FIG. 2 is a perspective view of an evaporator having the defrost assembly according to the present invention.
Figure 3:
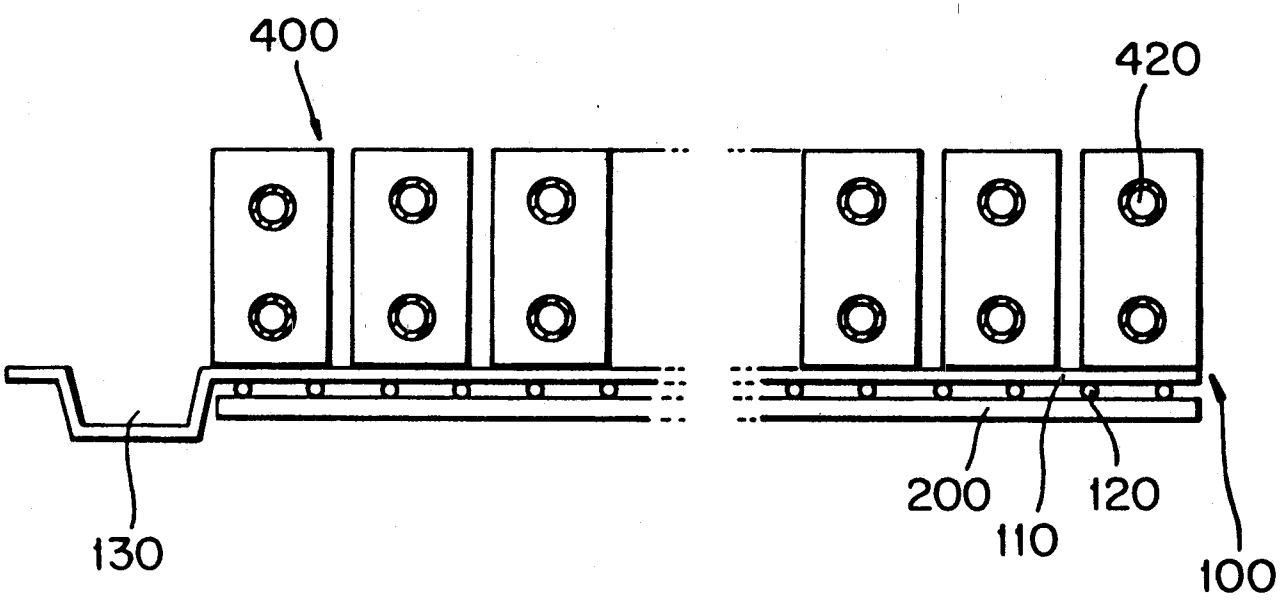
FIG. 3 is a sectional view illustrating a defrost assembly according to the present invention.
Figure 4:
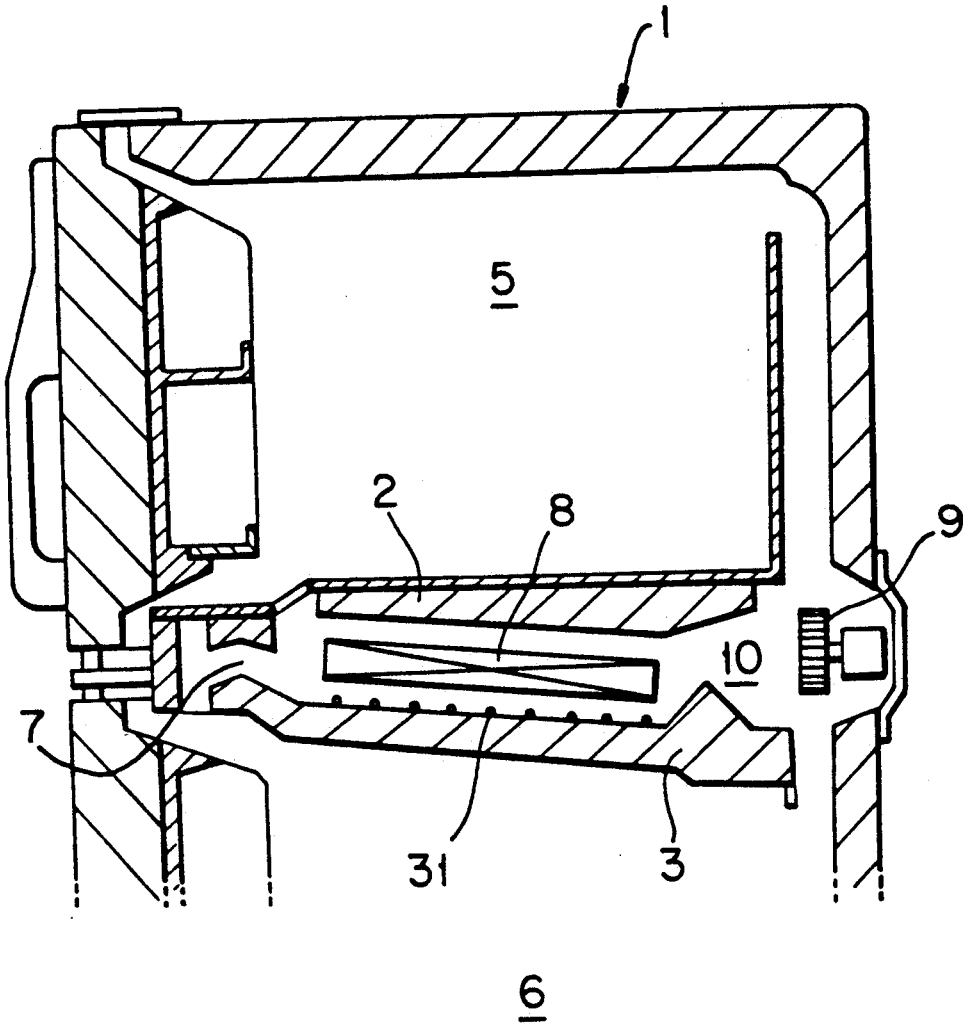
FIG. 4 (PRIOR ART)
FIG. 4 is a sectional view illustrating a refrigerator having a defrost assembly according to the prior art.

FIGS. 1,2 and 3 illustrate a defrost assembly in accordance with the preferred embodiment of the present invention.

An evaporator 400 used in the defrost assembly in the present invention is placed in the evaporating channel 7 between the upper partition 2 and the lower partition 3 in the same position as that of the prior art. The evaporator 400 comprises two brackets 410 mounted in the direction of the cooling air, a refrigerant tube 420 connecting with the brackets 410,410 in a plurality of loops, and a plurality of fins 430 juxtaposed between the brackets 420,420 which are secured to the tube 420 for increasing the heat-exchanging surface. Under the bottom surface of the evaporator 400 the defrost assembly is provided in the present invention. The defrost assembly comprises an insulating board 200 and a heating plate 100 superimposed on the insulating board 200. The heating plate 100 consists of a thin plate 110 made of aluminum or the like, a cord heater 120 attached across the under side of the thin plate 110 for transmitting the heat generated from the heater 110 to the brackets 410, the fins 430 and the refrigerant tube 420. Behind and down from the rear portion of the evaporator 400 a drain passage 130 is provided which gathers defrost water melted from the evaporator 400. Further, under the heating plate 100 the insulating board 200 is provided for preventing heat of the cord heater 120 from transferring to the foam resin insulating material in the lower partition 3. The material with thermostable and fire-extinguishing characteristics can be acceptable for the insulating board, and in this embodiment Foam-P.E. is used. Between the bottom end of the brackets 410 and that of the fins 430 of the evaporator 400 against the heating plate 100 a space can be introduced to some extent. In this embodiment, to achieve a more efficient defrost, the bottom end of the brackets 410 and that of the fins 430 of the evaporator 400 are connected throughout to the heating plate 100. On the upper refrigerant tube at the entrance portion of the evaporator 400 a bimetal 140 is mounted which periodically operates according to the detected temperature of the refrigerant tube, that is, the bimetal 140 cuts off electricity when the temperature of the evaporator rises above a predetermined temperature after the defrost cycle is completed. Below the bimetal 140 a temperature fuse 150 is installed near the thin plate 110 of the heating plate 100. The fuse 150 can detect the excessive heat of the cord heater 120 through the thin plate 110.

The defrost assembly in the present invention operates as follows.

Air which has completed the refrigerating operation in the freezing compartment 2 and the refrigerating compartment 3 flows into the evaporating channel 7. The air, which has a slightly higher temperature and a little humidity, comes into contact with the fins 430, the refrigerating tube 420 and the brackets 410 of the evaporator 400 and consequently ice develops on the elements of the evaporator 400. Once the ice is detected by the detecting means (not shown) the cord heater 120 is activated and then emits heat. The heat is transmitted to the thin plate 110 which is made of a material with good conductivity. The ice on the evaporator 400 is then melted by the transmitted heat from the thin plate 110. At the melting away of the ice, the temperature of the heating plate 100 will have already reached a relatively high temperature. However, the transmission of the excessive heat is interrupted by the insulating board 200, thereby preventing the foam-insulating material of the lower partition 3 from becoming deformed. Additionally, in the event that the bimetal 140 malfunctions, the thin plate 110 receives the heat continuously from the cord heater 120 and becomes excessively heated. The condition of the thin plate 110 is detected by the fuse 150 which is located near the thin plate 110 and the fuse 150 works to cut off the electricity which goes to the cord heater 120.

What is claimed is:

1. In a refrigerator comprising a freezer compartment, a refrigeration compartment vertically spaced apart from said freezer compartment by a space, a partition arranged to define a floor of said space, an evaporator and a defrost mechanism disposed in said space, said defrost mechanism comprising:

a thin substantially planar heating plate underlying said evaporator, said heating plate formed of a thermally conductive material, said evaporator seated on said heating plate, a heater disposed beneath and in contact with said heating plate for heating said heating plate, and a substantially planar thermal insulating board underlying said heater, said heating plate, together with said heater, being seated upon said thermal insulating board; said thermal insulating board being seated upon said floor of said space.

2. Apparatus according to claim 1, wherein said defrost mechanism comprises electricity cut-off means for shutting off a flow of electricity to said heating cord in response to a prescribed temperature build-up of said defrost mechanism.

3. Apparatus according to claim 2, wherein said electricity cut-off means comprises a first temperature-responsive shut-off device located in said evaporator adjacent said heating plate, and a second temperature-responsive shut-off device located in said evaporator remotely of said heating plate.

4. Apparatus according to claim 3, wherein said first cut-off means comprises a temperature fuse.

5. Apparatus according to claim 3, wherein said second cut-off means comprises a bi-metal device.

6. Apparatus according to claim 1, wherein said thermal insulating board is formed of a fire retardant material.

7. Apparatus according to claim 1, wherein said defrost mechanism is attached to a bottom surface of said evaporator.

8. Apparatus according to claim 1, wherein a rear portion of said heating plate forms a drain channel for conducting melted water.

9. Apparatus according to claim 1, wherein said heater comprises a heating cord of serpentine configuration.

* * * * *